US005308182A

United States Patent [19]

Lampert

[11] Patent Number: 5,308,182

[45] Date of Patent: May 3, 1994

[54] METERING CONTAINER AND SUPPORT CONSTRUCTION FOR THIS PURPOSE

[76] Inventor: Kurt Lampert, Neusand/Industriestrasse, FL-9495 Triesen, Liechtenstein

[21] Appl. No.: 856,025

[22] PCT Filed: Sep. 6, 1991

[86] PCT No.: PCT/CH91/00192

§ 371 Date: May 28, 1992

§ 102(e) Date: May 28, 1992

[87] PCT Pub. No.: WO92/04131

PCT Pub. Date: Mar. 19, 1992

[30] Foreign Application Priority Data

Sep. 7, 1990 [CH] Switzerland ..... 2932/90

[51] Int. Cl.[5] ..... B05G 17/025

[52] U.S. Cl. ..... 401/219; 401/208; 401/281; 401/205

[58] Field of Search ..... 401/208, 209, 219, 281, 401/263, 205, 21; 222/561, 555, 410, 364, 366, 485, 486

[56] References Cited

U.S. PATENT DOCUMENTS

| | | | |
|---|---|---|---|
| Re. 28,120 | 8/1974 | Plumer | 222/326 |
| 519,051 | 5/1894 | Terry | 401/208 |
| 1,773,820 | 8/1930 | Lysons | 401/281 X |
| 2,229,707 | 1/1941 | Testi | 401/219 |
| 3,076,995 | 2/1963 | Rabelow | 401/219 X |
| 3,104,413 | 9/1963 | Nelson | 401/208 X |
| 3,486,665 | 12/1969 | La Croce | 222/561 X |
| 4,082,204 | 4/1978 | Savage | 222/485 X |
| 5,026,193 | 6/1991 | Lucas | 401/208 X |
| 5,038,967 | 8/1991 | Braun | 215/338 X |

FOREIGN PATENT DOCUMENTS

| | | | |
|---|---|---|---|
| 494453 | 3/1930 | Fed. Rep. of Germany . | |
| 1206141 | 6/1964 | Fed. Rep. of Germany . | |
| 7538002 | 4/1976 | Fed. Rep. of Germany . | |
| 3526734 | 1/1987 | Fed. Rep. of Germany . | |
| 1197509 | 12/1959 | France . | |
| 1290215 | 3/1962 | France . | |
| 1420454 | 11/1965 | France | 401/205 |
| 2557816 | 7/1985 | France . | |
| 594447 | 1/1978 | Switzerland . | |

*Primary Examiner*—Danton D. DeMille

[57] ABSTRACT

A metering container for viscous liquids has a container space enclosed by a container wall and a substantially circular mouthpiece at the lower surface of the container space having a wall with a slot opening arranged eccentrically with respect to its central axis. A rotary slide in the region of the slot opening is rotatable about the central axis and has a rotary slide wall with a slot that is substantially as eccentric with respect to the central axis as the slot opening is and is at least approximately the same size as the slot opening. The rotary slide is rotatable from an open position in which the slot opening and the slot are arranged one above the other to a closed position in which the slot opening is covered by the rotary slide wall and the slot is covered by the mouthpiece wall. The slot opening and the slot each extend as a straight line along an axis and have longitudinal edges that make an adjustable angle with one another in the manner of a scissors on rotation of the rotary slide.

16 Claims, 2 Drawing Sheets

METERING CONTAINER AND SUPPORT CONSTRUCTION FOR THIS PURPOSE

BACKGROUND OF THE INVENTION AND RELEVANT PRIOR ART

In addition to the thixotropic liquids, viscous liquids form an important group among the liquids with non-Newtonian behavior, which require special measures and means for their handling. This also applies to the design of metering containers.

The invention relates to a metering container for viscous liquids having an opening in a container space for the viscous liquids and means for closing the container opening.

A metering container has been disclosed in, for example, DE-C-1 206 141 for the application of glue. Two closing means are provided for closing the container, namely a slide for separating the container space from the applicator roller and two slides which can be moved toward one another in the manner of a gate, overlap the applicator roller and are intended to prevent drying out.

On the one hand, the inner slide which closes the container space presented a problem since it had to be operated from the outside, which made sealing difficult, especially since one section of the slide was always outside the container and one section inside, and there was always displacement between these parts during opening and closing. During these movements, the adhering glue was conveyed to the outside and could drip freely there, so that the work was not clean.

On the other hand, operation of the two outer slides with the aid of a cord pull against the force of a spring was not only rather complicated in design and susceptible to faults, but it did not prevent drying out during long periods of standing, which—owing to the large number of parts—then led to complicated cleaning work.

For non-adhesive substances, various metering containers have been proposed, for example in US-E-28 120. However, these are sector-like slots which extend parallel to the circumference of the rotary slide and on the one hand permit only a limited application width and on the other hand could not completely prevent thread formation when tacky substances were used, since both slots are located on the same radius and there would be a thread-cutting shearing effect only when their edges curved with respect to a chord plane relative to their curvature result in nonuniform glue application so that for this reason alone they are unsuitable for this purpose.

FR-A-1 197 509 adopted another approach to the solution of the problem. There, a metering roller acting on the actual applicator roller itself defines two metering gaps on its two sides in that this metering roller is arranged exactly in the bottom opening of the container and projects partly into the container space and partly outside. To close the two gaps remaining at its two sides, a thin spindle is inserted in each case between the metering roller and the concave container bottom and is intended to cover the gap.

A precondition of this solution is that the two spindles are produced very precisely in order to avoid leaving a cavity, and that the glue (or another viscous liquid) contains no lumps or impurities which could become lodged between the spindles and the container wall and thus prevent the sealing effect of the two spindles. In addition, during operation the metering roller continuously rubs against one of the spindles, which therefore impairs the functioning and the rotation of this roller, while the spindle on the other side of the metering roller is constantly raised from its sealing position as a result of its rotation, after which a return to the sealing position within the viscous medium is not ensured by anything.

However, if leaks occur in the known embodiments, the viscous liquid flows out in thin threads which are deposited everywhere and are difficult to remove. It is therefore the object of the invention to provide a metering container of the type stated at the outset so that it is easy to seal, does not carry viscous liquid, such as glue, together with surface sections pushed outside, and that the seal holds it securely in its closed position without there being any danger of contaminating thread formation.

SUMMARY OF THE INVENTION

This object is achieved in a surprisingly simple manner by a metering container for viscous fluids, comprising a container space enclosed by a container wall that has a lower surface; a substantially circular mouthpiece at the lower surface of the container space that has a central axis and a mouthpiece wall with a slot opening arranged eccentrically with respect to the central axis; a closing means in the region of the slot opening comprising a rotary slide rotatable about the central axis that has a rotary slide wall substantially parallel to the mouthpiece wall with a slot arranged substantially as eccentrically as the slot opening and at least approximately the same size as the slot opening; a means for rotating the rotary slide from an open position in which the slot opening and the slot are arranged one above the other to a closed position in which the slot opening is covered by the rotary slide wall and the slot is covered by the mouthpiece wall. The slot opening and the slot each extend as a straight line along an axis and have longitudinal edges that make an adjustable angle with one another in the manner of a scissors on rotation of the rotary slide. Further improvements and embodiments of the invention are as follows:

At least one applicator roller has an axis of rotation running almost parallel to the slot and is arranged on the rotary slide. The rotary bearing surfaces, in particular of plastic material, keep the rotary slide centered in the region of its circumference and are connected to the mouthpiece, and the rotary bearing surfaces preferably comprise a retaining surface engaging at the circumference and a projecting annular centering surface.

The container space is bent by a predetermined angle relative to the mouthpiece, and their two longitudinal axes make an angle between 0 and 90 with one another, preferably 45 to 80, in particular about 60 to 75, and a support construction supporting the bent container part is provided.

The container has an axis of rotation of the roller that is offset relative to the central axis running along the slot. The axis of rotation is displaced toward the direction that the container space is bent.

At least one catch for determining at least one of the rotary positions of the rotary slie, in particular the open position is coordinated with the rotary slide. Preferably, the catch consists of plastic.

The mouthpiece is formed as a body separate from the container wall and is connected thereto. The support construction has a support section holding the bent container space and a container section, which is connected to the support section for holding at least one part of the rotary slide. The container section of the support construction has a shoulder to support a projecting, for example annular, surface of the mouthpiece, in particular on a circumferential rotary bearing. The support section is in the form of a housing, preferably blow molded, and encloses at least one cavity with its housing walls.

Because the rotary slide wall of the rotary slide is parallel to the mouthpiece wall, no closure wall part moves to the outside during the movement from the opening position to the closed position, or vice versa, and no contamination can take place. Moreover, the rotary slide cannot be moved from its closed position by accidental influences. Finally, however, the cooperation of the two linear eccentric slots produces an effect used by housewives, for example when metering honey or other viscous liquids, when they scrape obliquely across the surface from which a thin thread of this liquid is running: here, too, the edges of these slots have a scissors-like action and "cut" glue threads or the like which are forming. As an additional effect there is the possibility of adjustment of the slot width, the linearity of the slots permitting substantially uniform metering over the entire width with respect to an area to be coated.

DESCRIPTION OF THE DRAWINGS

Further details of the invention are evident from the following description of preferred embodiments shown schematically in the drawings, in which.

DETAILED DESCRIPTION

Figure 1:
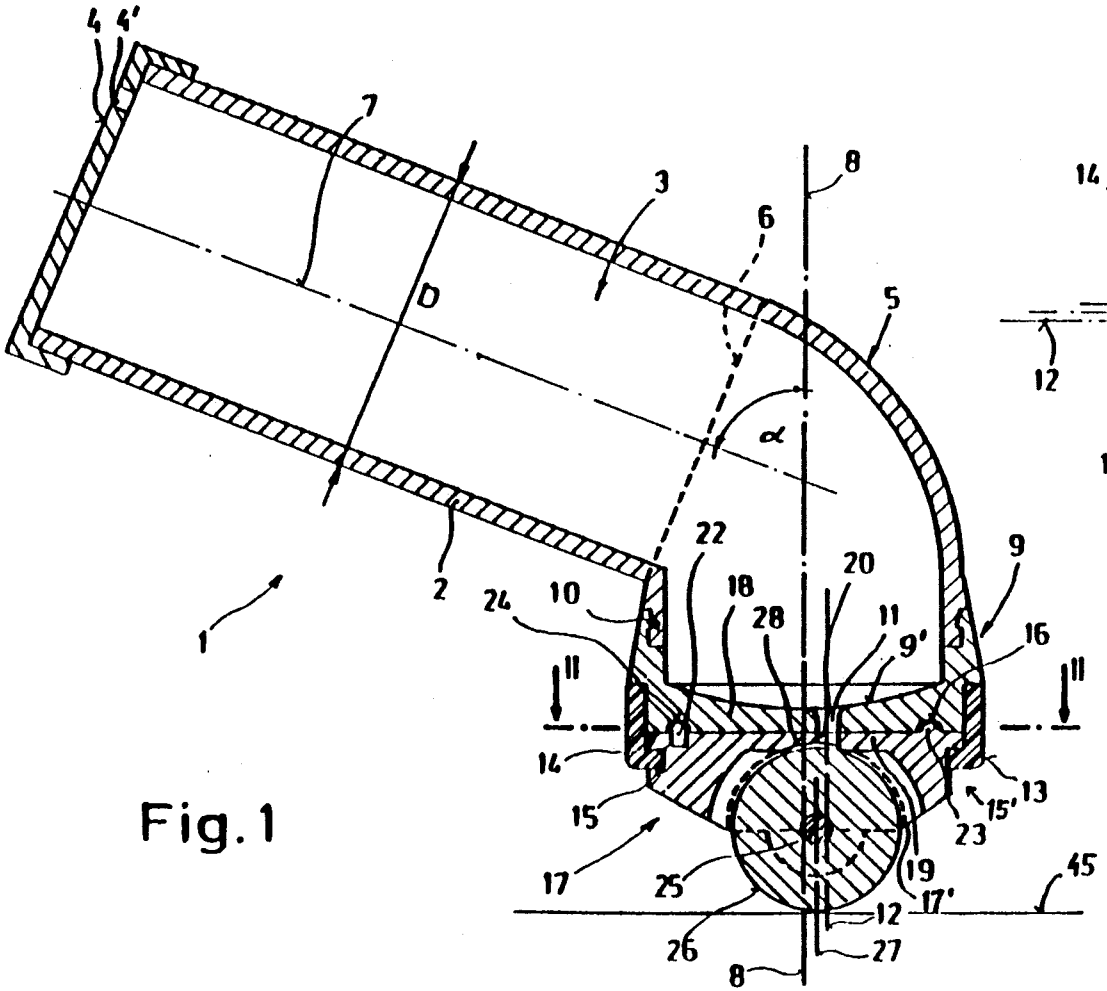
FIG. 1 shows a longitudinal section of a preferred embodiment of metering container according to the invention.

A metering container 1 according to FIG. 1 has a container space which is surrounded by container walls 2 and can be snapped on or screwed on. The latter preferably has, in its upper part, an opening 4' through which air can flow into the container space 3 during metering of the viscous liquid, in order to prevent the generation of reduced pressure, which might prevent further flow. In the rest position, the opening 4' is preferably closable by a spring cover or the like (not shown), in order to prevent drying out. A bent section 5 is located at the lower end of container 1, which end is opposite the cover 4; the said section can be formed as an integral part with the container wall 2 in the embodiment shown but in the case of FIG. 3 may be formed as a separately produced part joined to the container wall 2, along the parting surface 6 shown there with a solid line, if this facilitates production.

The container space 3 is extended along an axis 7 and only of limited diameter so that it can be gripped with a hand on the outside in the manner of a handle. Its circumference is therefore preferably less than 40 cm, whereas its length is not critical. A circumference of 30 to 35 cm best meets the requirements for as large a volume as possible in conjunction with adequate convenience of handling.

To comply with its intended use as a handle, the container axis 7 makes an angle of less than 90° with an axis 8 of the bent section 5 and of a connected mouthpiece 9, i.e. it makes an angle $\alpha$ of 45° to 80° (in an upward direction), preferably 60° to 75°, with the axis 8, so that the container space 3 projects slightly upward.

As can be seen, the mouthpiece 9 can be produced as a separate part and then connected to the section 5. Connection is preferably effected by snapping on by means of catch-like groove and spring surfaces 10 which engage one another. Advantageously, catches (not shown) are provided here on rotation at 0° and 90°, in order to facilitate the setting of the operating position and of the rest position. To apply glue from the container space 3, 5 to the lateral edge 45 (at right angles to the plane of the drawing) of a furniture panel lying in the plane of the drawing in FIG. 1, the container space 3 is rotated through 90° about the axis 8 relative to its mouthpiece 9 so that it projects upward at right angles out of the plane of the drawing and also covers the entire slot opening 20 with glue even when the container space 3 is only partly full. Such a snap connection, for which incisions can also be made in the inner wall of the section 5 in order to form the surfaces 10 on flexible tongues, is particularly easy to produce if the metering container 1 consists of plastic.

The mouthpiece 9 has a slot opening 11 with a slot axis 12 outside the axis 8 on its cambered bottom 9'. This slot opening 11 is preferably located on that side which is opposite the container space 3 and its bent axis 7. It is also preferable if the bottom 9' does not have a cap-like camber but is in the form of an inverted roof, the slot 11 forming the ridge, because the slot depth can then be kept constant over the entire slot length and hence uniform metering of the viscous liquid over the entire width can be ensured.

Figure 2:
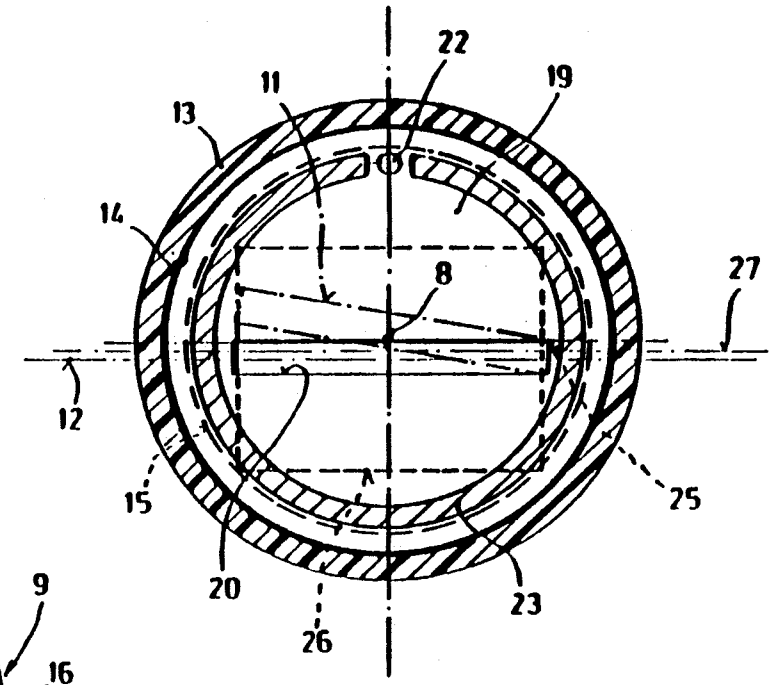
FIG. 2 shows a section along the line II—II of FIG. 1.

The section in FIG. 2 furthermore shows that at least the mouthpiece 9 is at least almost circular in plan view (apart from any added projections) and carries a rotary bearing 13 at its circumference. This bearing 13 may also be in the form of a union nut. The rotary slide 17 (see below) is then tapered at its circumference, as indicated by the arrow 15' on the right side of FIG. 1. Its inward-pointing rotary bearing surfaces 14, 15 (left in FIG. 1), of which the latter serve as retaining surfaces, can be formed from softer, close-fitting and therefore sealing material. This is not in contradiction to the requirement for an exact rotary bearing guidance if the mouthpiece 9 additionally has a centering surface 16 in the form of an annular groove (a projection or a number thereof would also be possible).

These bearing surfaces 14 to 16 serve as a bearing for a rotary slide 17 which is mounted on the mouthpiece 9 and has a rotary slide wall 19 parallel to the mouthpiece wall 18. The rotary bearing surfaces 14, 15 define an axis of rotation which coincides with the axis 8. However, the rotary slide 17 also has a slot 20 which in an open position (according to FIG. 1) is at least almost flush or congruent with the slot opening 11 and is located at slot axis 12, which, as mentioned, is arranged eccentrically with respect to the axis of rotation 8. Thus, if the rotary slide 17 is rotated about its axis of rotation 8, after a rotation of 180° the slot 20 can reach the closed position which is indicated by a dashed line in FIG. 3 and in which the rotary slide wall 19 covers the slot opening 11, and the mouthpiece wall 18 covers the slot 20. In the closed position, the adjacent edges of slot 20 and slot opening 11 are preferably a distance apart—even if only a small distance.

In such a rotary movement, there are a number of intermediate positions in which the edges of the two openings have a scissors-like action (cf. the dash-dot position of the slot opening 11 relative to the slot 20 in FIG. 2) and thus prevent thread formation by the viscous liquid by means of a cutting procedure. However, this geometric circumstance can also if desired be utilized for changing the length of the uncovered opening cross-section by rotation of the rotary slide 17 if, for example, it is intended to glue edges of different widths. In such a case, it is expedient if mouthpiece 9 and rotary slide 17 have scale markings 21 which cooperate with one another (FIG. 3) and indicate the width of the uncovered opening cross-section. Furthermore, it may be expedient to coordinate catches with certain slot widths; the rotary slide 17 may therefore also be polygonal.

Such a catch for the open position of the rotary slide 17 is shown in FIG. 1. The rotary slide 17 has a catch projection 22, which may be spring-loaded, and which projects slightly beyond the height of an annular centering projection 23 (shown in section in FIG. 2) which engages the groove 16, so that said locking projection can fall into a catch indentation 24 of the mouthpiece 9. Here too, there is an advantage due to the intrinsic resilience of the material if at least the rotary slide 17 consists of plastic. If the catch projection 22 is spring-loaded, it may interfere with the tightness, owing to the pressure exerted on the opening; it is therefore preferable to allow it to rest in a groove running along a semicircle, in each case at 0° and 180°.

In the embodiment shown, the rotary slide 17 has an applicator roller 26 which is mounted on an axle 25 (which is preferably in the form of a spring bolt which has a snap fit in the axle hole) and whose geometric axis 27 is likewise arranged eccentrically with respect to the axis of rotation 8 but is preferably offset to the left relative to the slot axis 12 in the direction of the bent axis 7 (based on FIG. 1). The effect achieved is clearly recognizable in FIG. 1 since flowing of the liquid onto the applicator roller 26 is facilitated on that side which faces away from the container space 3 and which becomes the front during gluing, but becomes more difficult on the side of the container space 3 (the rear), which is assisted by a surface section 28 of the rotary slide wall 19, which section continues around the roller 26 and thus has a somewhat arc-like shape. The play between the roller 26 and the rotary slide 17 is otherwise kept as small as shown in FIG. 1 not only in the surface section 28 but (as indicated by the dashed line) also as far as the lower outflow 17'.

Of course, mounting an applicator roller 26 is preferable but not absolutely essential. It would be just as possible to provide an applicator brush, or two or more rollers could interact with one another at the rotary slide 17, one of which rollers, for example, is a metering roller as disclosed in FR-A-1 197 509, or two rollers together form a liquid intake gap (cf. DE-U-75 38 002).

The reason why it is advantageous to bend the axes 7, 8 relative to one another has been described above. Particularly under these conditions, however, setting up and storing such a metering container 1 is difficult, especially when it should not be allowed to rest on the applicator roller 26 provided with tacky liquid. It is therefore advantageous if the container 1 is provided with a support construction as shown, for example, in FIG. 3. At least with regard to a support section 29, this support construction can in principle be connected to the container 1, but the latter is of course easier to handle if the entire support construction is formed as a separate part.

Figure 3:
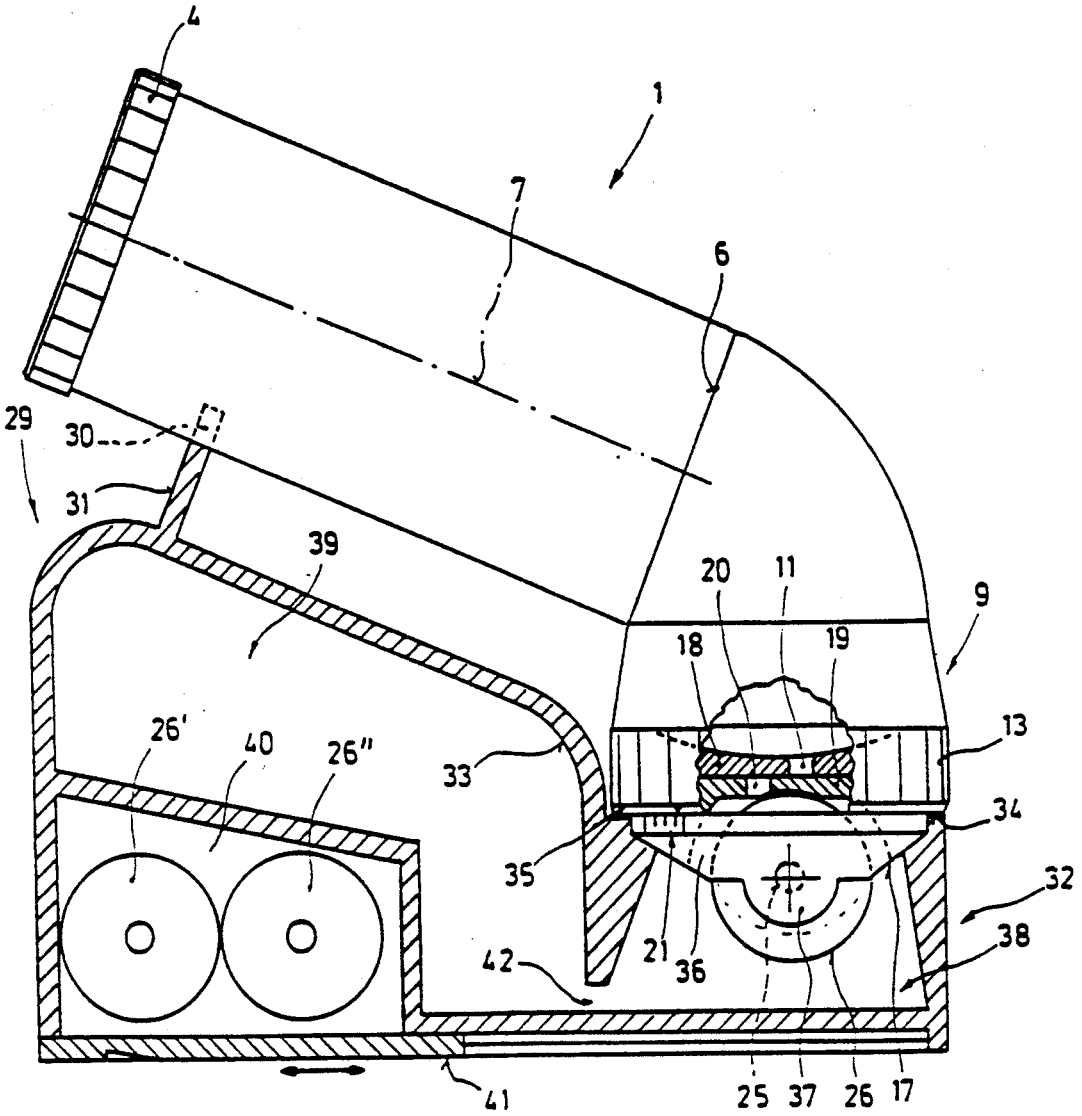
FIG. 3 shows the metering container according to FIG. 1 in side view but with its rotary slide in the closed position when the container is supported on a support construction shown in section.

In FIG. 3, the support section 29 has a trough 30, in particular on a web 31, which trough holds part of the container wall 2 at its lower surface. Adjacent to the support section 29 is a container section 32 which holds the mouthpiece 9 or the rotary slide 17 and in which at least part of the rotary slide 17 dips, if necessary also part of the mouthpiece 9, in which case the container section 32 could be provided on its right side too (based on FIG. 3) with a higher wall, similarly to a curved wall section 33 on its left side, in order more or less to surround the mouthpiece 9.

The container section 32 preferably has a shoulder 34 which surrounds it in the manner of a ring in order to serve as a support surface for a projecting mouthpiece section 35, which in this case is annular. In the container 1 used, the container section 32 can be filled with water up to this shoulder 34 in order to dissolve glue (or another viscous liquid) adhering to the rotary slide 17. The rotary slide with a conical actuating surface 36 for executing its rotation, and with the axle 25 for the bearing pieces 37 carrying the applicator roller 26, therefore project into the interior of the container section for this purpose. The bearing pieces 37 are preferably not concentric with the roller 26 but are broadened (as indicated by the dashed line in FIG. 3), to prevent to carrying over of excess glue.

The inner space 38 is expediently connected to a relatively large container space 39 to prevent the dissolved viscous liquid inside the space 38 from becoming too concentrated. For this purpose, the space below the supporting web 31 is utilized for accommodating the space 39, but expediently also a space 40 for spare rollers 26', 26'', if necessary of different axial length and/or different surface area or different diameter. The space 40 can be closed by a door 41 (in particular a sliding door); the space 39 can be made accessible by an opening, for example a screwable opening, which is not shown, for filling with water.

It is clear that the spaces 38, 39 communicate with one another via a common opening 42, but it may be desired also to provide an upper opening in addition to this lower communicating opening 42. Finally, it would also be possible to accommodate a pump or the like inside the space 39 in order to keep the water in motion and thus facilitate the cleaning process.

It is clear that, by means of the arrangement according to the invention and the embodiment of the rotary slide 17, no surface smeared with viscous liquid, such as glue, can reach the outside, since all surfaces coming into contact with this liquid, in particular on the walls 18 and 19, are always enclosed by the bearing surfaces 14, 15 of the bearing 13. For cleaning purposes, it may be desirable to provide the bearing 13 with an internal thread adjacent to the surface 14, which thread cooperates with a corresponding external thread on the mouthpiece 9.

Figure 4:
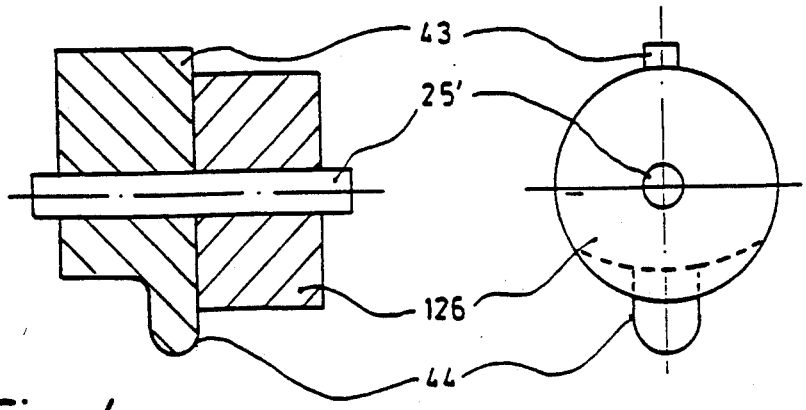
FIG. 4 shows a spare roller with reduced length in longitudinal section and an axial plan view.

FIG. 4 shows a spare roller 126 of reduced length on its axle 25' on which a plate 43, 44 which is firmly connected to the axle 25' is adjacent to the roller 126 and, by means of a projection 43, engages the slot 20 and closes its region not arranged above the rotatable roller 126, thus preventing the emergence of glue there. On that side of the plate which is opposite the projection 43 is a projection 44 which serves for resting against the surface of, for example, a blockboard if its narrow edge is to be provided with a glue coat and the apparatus according to the invention is slid along it.

The invention is suitable not only for applying glue to edges of blockboards or furniture panels but—if necessary with adaptation of the individual parts and dimensions—also, for example, for fastening flexible skirting boards to vertical walls, for stripwise application of glue in office, household or hobby work, etc.

Many modifications are of course possible within the scope of the invention; thus, the centering surfaces 16, 23 (the projecting and the indented part of which may also be arranged in the converse order) need not be present but, as can be seen, are expediently in the region of the circumference of the rotary slide wall 19. The support container 32, 39, at least without the chamber 40, can also be blow-molded, which is substantially more economical than the embodiment according to FIG. 3, which is to be produced only by injection molding.

I claim:

1. A metering container for viscous thixotropic liquids, comprising a container having a container wall, said container having a lower end, a substantially circular mouthpiece at said lower end of said container, said mouthpiece having a central axis and a mouthpiece wall with a first slot opening arranged eccentrically with respect to said central axis, said first slot opening being elongated and having a longitudinal axis extending substantially parallel to a plane through said central axis, closing means in the region of said first slot opening comprising a rotary slide rotatable about said central axis and having a rotary slide wall substantially parallel to said mouthpiece wall, with a second slot opening arranged substantially as eccentrically and parallel to said central axis as said first slot opening, said second slot opening being at least approximately the same size as said first slot opening, means for rotating said rotary slide from an open position in which said first slot opening and said second slot opening are arranged one above the other to a closed position in which said first slot opening is covered by said rotary slide wall and said second slot opening is covered by said mouthpiece wall, said first slot opening and said second slot opening having straight longitudinal edges that make an adjustable angle with one another in the manner of a scissors on rotation of said rotary slide, and at least one applicator roller arranged on said rotary slide, having an axis of rotation running substantially parallel to said longitudinal axis of said second slot opening, said applicator roller having a roller surface that runs close to said second slot opening.

2. A container as claimed in claim 1, wherein said mouthpiece comprises a body separate from said container wall and is connected thereto, said body being rotatably with respect to said container.

3. A container as claimed in claim 1, further comprising rotary bearing surfaces connected to said mouthpiece for keeping said rotary slide centered in the region of the circumference of said rotary slide.

4. A container as claimed in claim 3, wherein said rotary bearing surfaces comprise a retaining surface engaging at said circumference of said rotary slide and a projecting annular centering surface.

5. A container as claimed in claim 4, wherein said rotary bearing surfaces are composed of plastic material.

6. A container as claimed in claim 3, wherein said rotary bearing surfaces are composed of plastic material.

7. A container as claimed in claim 1, wherein said container space has a longitudinal axis that is bent by a pre-determined angle between 0° and 90° relative to said central axis of said mouthpiece, further comprising a support construction supporting said bent container space.

8. A container as claimed in claim 7, wherein said bent longitudinal axis of said container space is bent at a predetermined angle between 45° and 80° relative to said central axis of said mouthpiece.

9. A container as claimed in claim 8, wherein said bent longitudinal axis of said container space is bent at a predetermined angle between 60° and 75° relative to the said central axis of said mouthpiece.

10. A container as claimed in claim 7, wherein said support construction has a support section for holding said bent container space and a container section connected to said support section for holding at least one part of said rotary slide.

11. A container as claimed in claim 1, wherein said second slot opening is elongated and has a longitudinal axis, and said axis of rotation of said applicator roller is offset relative to said longitudinal axis of said second slot opening.

12. A container according to claim 11, wherein said axis of rotation of said applicator roller is offset relative to said longitudinal axis of said second slot opening in the direction of said central axis of said mouthpiece, in said open position of said rotary slide.

13. A container as claimed in claim 1 further comprising at least one catch for determining at least one rotary position of said rotary slide.

14. A container as claimed in claim 13, wherein said catch determines said open position of said rotary slide.

15. A container as claimed in claim 13, wherein said catch is composed of plastic material.

16. A metering container for viscous thixotropic liquids, comprising a container having a container wall, said container having a lower end, a substantially circular mouthpiece at said lower end of said container, said mouthpiece having a central axis and a mouthpiece wall with a first slot opening arranged eccentrically with respect to said central axis, said first slot opening being elongated and having a longitudinal axis extending substantially parallel to a plate through said central axis, closing means in the region of said first slot opening comprising a rotary slide rotatable about said central axis and having a rotary slide wall substantially parallel to said mouthpiece wall, with a second slot opening arranged substantially as eccentrically and parallel to said central axis as said first slot opening, said second slot opening being at least approximately the same size as said first slot opening, means for rotating said rotary slide from an open position in which said first slot opening and said second slot opening are arranged one above the other to a closed position in which said first slot opening is covered by said rotary slide wall and said second slot opening is covered by said mouthpiece wall, said first slot opening and said second slot opening having straight longitudinal edges that make an adjustable angle with one another in the manner of a scissors on rotation of said rotary slide, at least one applicator roller arranged on said rotary slide, having an axis of rotation running substantially parallel to said longitudinal axis of said second slot opening, said applicator roller having a roller surface that runs close to said second slot opening, a projecting surface projecting from said mouthpiece, a support construction having a container section for holding said rotary slide, wherein said support construction comprises a housing with housing walls enclosing at least one cavity, and said support construction and said container section are arranged to receive said projecting surface and said slide in an opening in said container section in a plate that is substantially horizontal in use.

* * * * *